US011653702B2

(12) United States Patent
Liu

(10) Patent No.: US 11,653,702 B2
(45) Date of Patent: May 23, 2023

(54) ATOMIZATION ASSEMBLY AND ELECTRONIC CIGARETTE COMPRISING THE SAME

(71) Applicant: Tuanfang Liu, Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 338 days.

(21) Appl. No.: 17/020,793

(22) Filed: Sep. 14, 2020

(65) Prior Publication Data

US 2021/0177058 A1 Jun. 17, 2021

(30) Foreign Application Priority Data

Dec. 12, 2019 (CN) ..... 201911279676.8
Dec. 12, 2019 (CN) ..... 201922233951.4

(51) Int. Cl.
*A24F 40/46* (2020.01)
*A24F 40/40* (2020.01)

(52) U.S. Cl.
CPC ..... *A24F 40/46* (2020.01); *A24F 40/40* (2020.01)

(58) Field of Classification Search
CPC ..... A24F 40/46; A24F 40/40
See application file for complete search history.

(56) References Cited

U.S. PATENT DOCUMENTS

2017/0042228 A1* 2/2017 Liu ..... A24F 47/008
2018/0325172 A1* 11/2018 Zhu ..... A24F 47/008
2020/0338282 A1* 10/2020 Trzecieski ..... A61M 11/042

* cited by examiner

*Primary Examiner* — Michael J Felton
*Assistant Examiner* — Ronnie Kirby Jordan
(74) *Attorney, Agent, or Firm* — Matthias Scholl P.C.; Matthias Scholl

(57) ABSTRACT

An atomization assembly, including a heating module. The heating module includes a sleeve, a filter screen, a container, a support, and a ceramic core. The ceramic core includes three or more heating elements connected in parallel. The ceramic core is fixed on the support. The container is disposed on the top end of the ceramic core. The filter screen is disposed on the top opening of the container. When in use, the ceramic core produces heat to heat the smoke material stored in the container.

3 Claims, 6 Drawing Sheets

ATOMIZATION ASSEMBLY AND ELECTRONIC CIGARETTE COMPRISING THE SAME

CROSS-REFERENCE TO RELATED APPLICATIONS

Pursuant to 35 U.S.C. § 119 and the Paris Convention Treaty, this application claims foreign priority to Chinese Patent Application No. 201911279676.8 filed Dec. 12, 2019, and to Chinese Patent Application No. 201922233951.4 filed Dec. 12, 2019. The contents of all of the aforementioned applications, including any intervening amendments thereto, are incorporated herein by reference. Inquiries from the public to applicants or assignees concerning this document or the related applications should be directed to: Matthias Scholl P.C., Attn.: Dr. Matthias Scholl Esq., 245 First Street, 18th Floor, Cambridge, Mass. 02142.

BACKGROUND

The disclosure relates to an atomization assembly and an electronic cigarette comprising the same.

A conventional electronic cigarette includes only one heating element, and the smoke material is directly placed on the heating element for vaporization.

SUMMARY

The disclosure provides an atomization assembly, comprising a heating module; the heating module comprises a sleeve, a filter screen, a container, a support, and a ceramic core, the ceramic core comprises three or more heating elements connected in parallel; the ceramic core is fixed on the support, the container is disposed on a top end of the ceramic core; the filter screen is disposed on a top opening of the container; when in use, the ceramic core produces heat to heat a smoke material stored in the container.

Also provided is an electronic cigarette comprising the atomization assembly, a battery assembly, and a base assembly; the base assembly comprises a top surface provided with a first threaded hole and a second threaded hole disposed abreast with each other; the atomization assembly and the battery assembly are disposed side by side in the first threaded hole and the second threaded hole of the base assembly.

In a class of this embodiment, the atomization assembly further comprises a mouthpiece, a first seal ring, a glass tube, a conduit, a second seal ring, and a first electrode; the first electrode is disposed on a bottom end of the heating module for electric conduction; the second seal ring is disposed on a bottom end of the conduit to seal a bottom opening of the glass tube; the glass tube is disposed on the conduit; the first seal ring is disposed between a bottom end of the mouthpiece and a top end of the glass tube to seal a top opening of the glass tube; the heating module is connected to the conduit; and the sleeve of the heating module is in threaded connection to the conduit.

In a class of this embodiment, the base assembly comprises a pair of screws, a control panel, a fixing seat, and a base cover; the control panel is disposed in the fixing seat; the pair of screws is fixed on the fixing seat, and the base cover is connected to the fixing seat.

DETAILED DESCRIPTION

To further illustrate, embodiments detailing an atomization assembly and an electronic cigarette comprising the same are described below. It should be noted that the following embodiments are intended to describe and not to limit the disclosure.

Smoke materials refer to smoke oil, tobacco, tobacco and other materials used to produce smoke.

Figure 1:
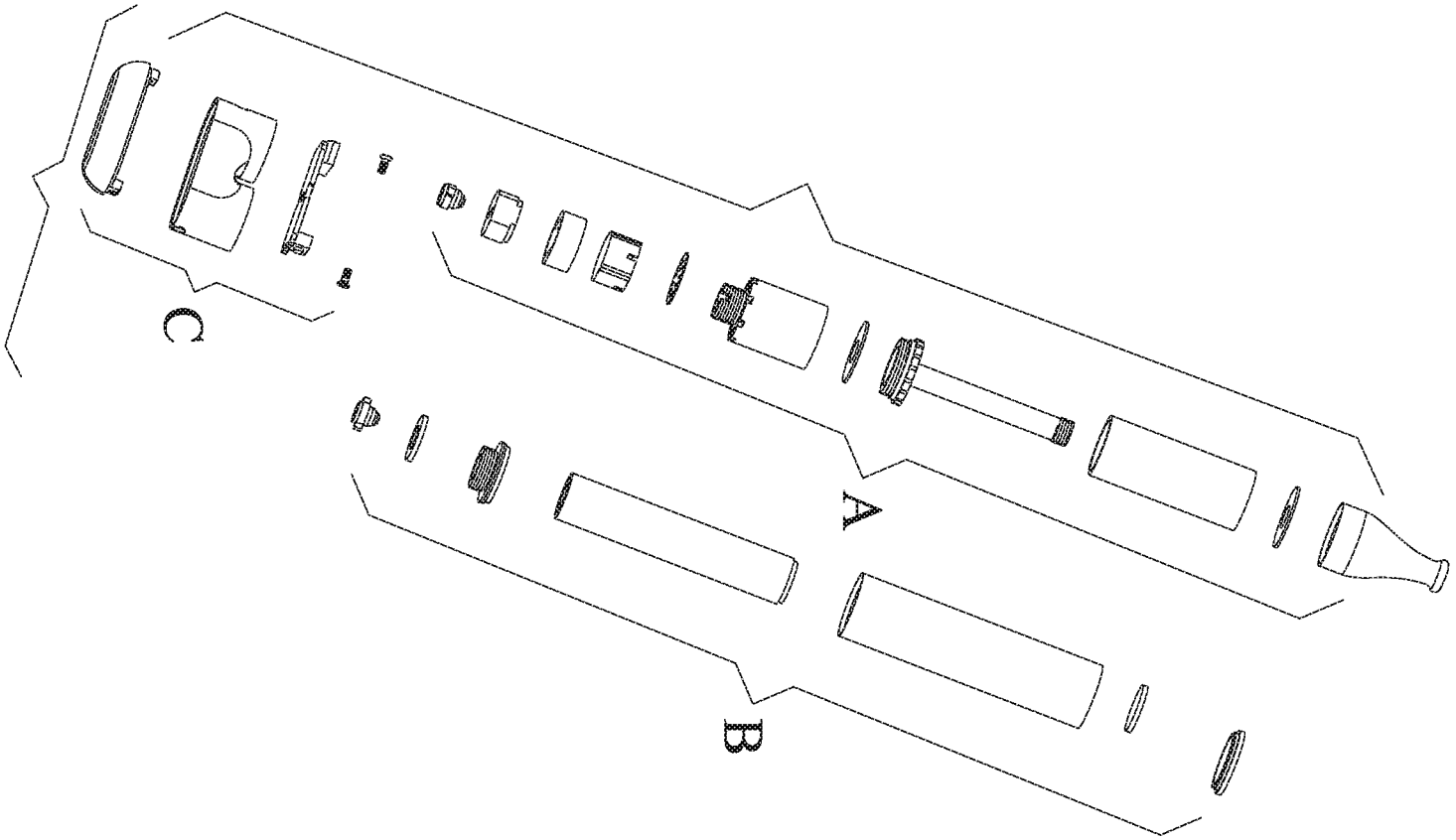
FIG. 1 is an exploded view of an electronic cigarette according to one embodiment of the disclosure.
Figure 2:
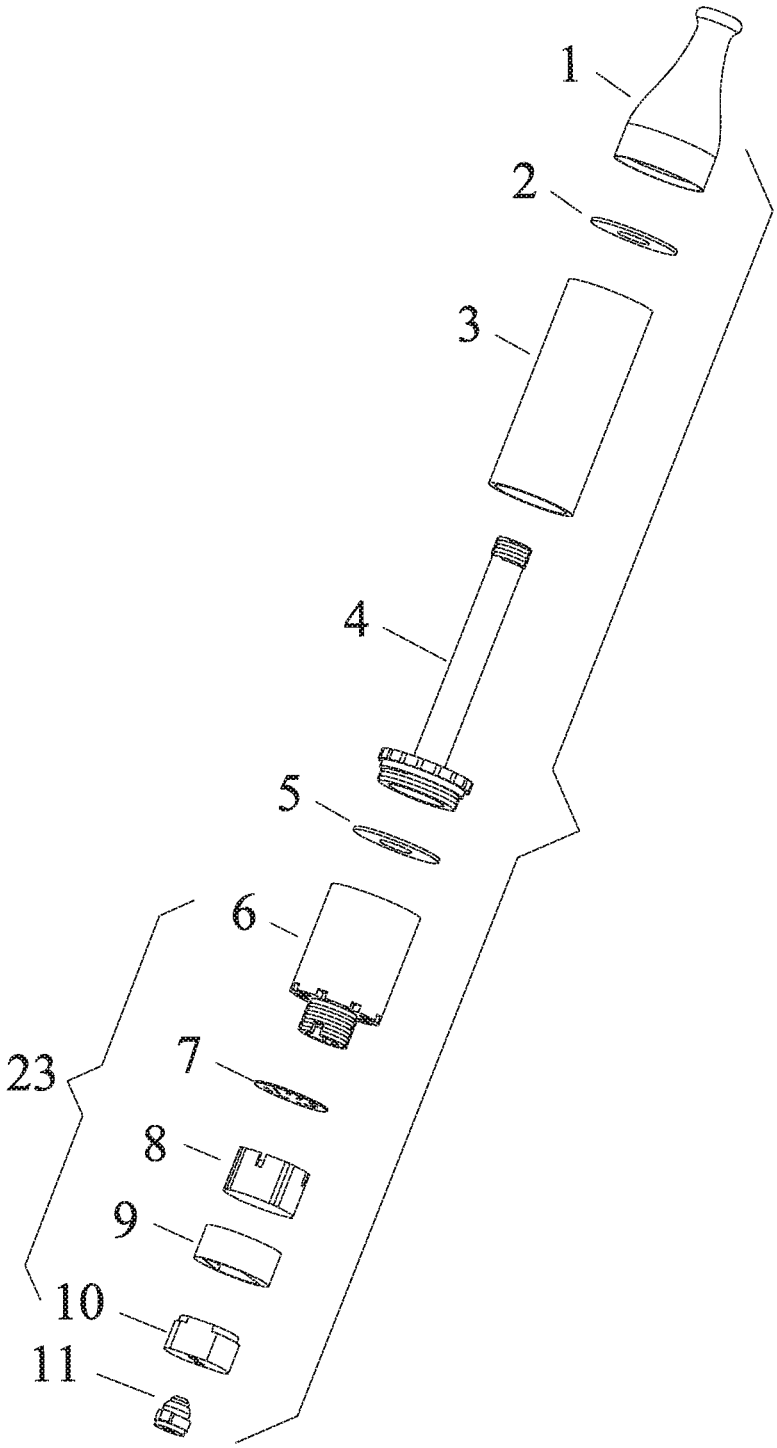
FIG. 2 is an exploded view of an atomization assembly of an electronic cigarette according to one embodiment of the disclosure.
Figure 3:
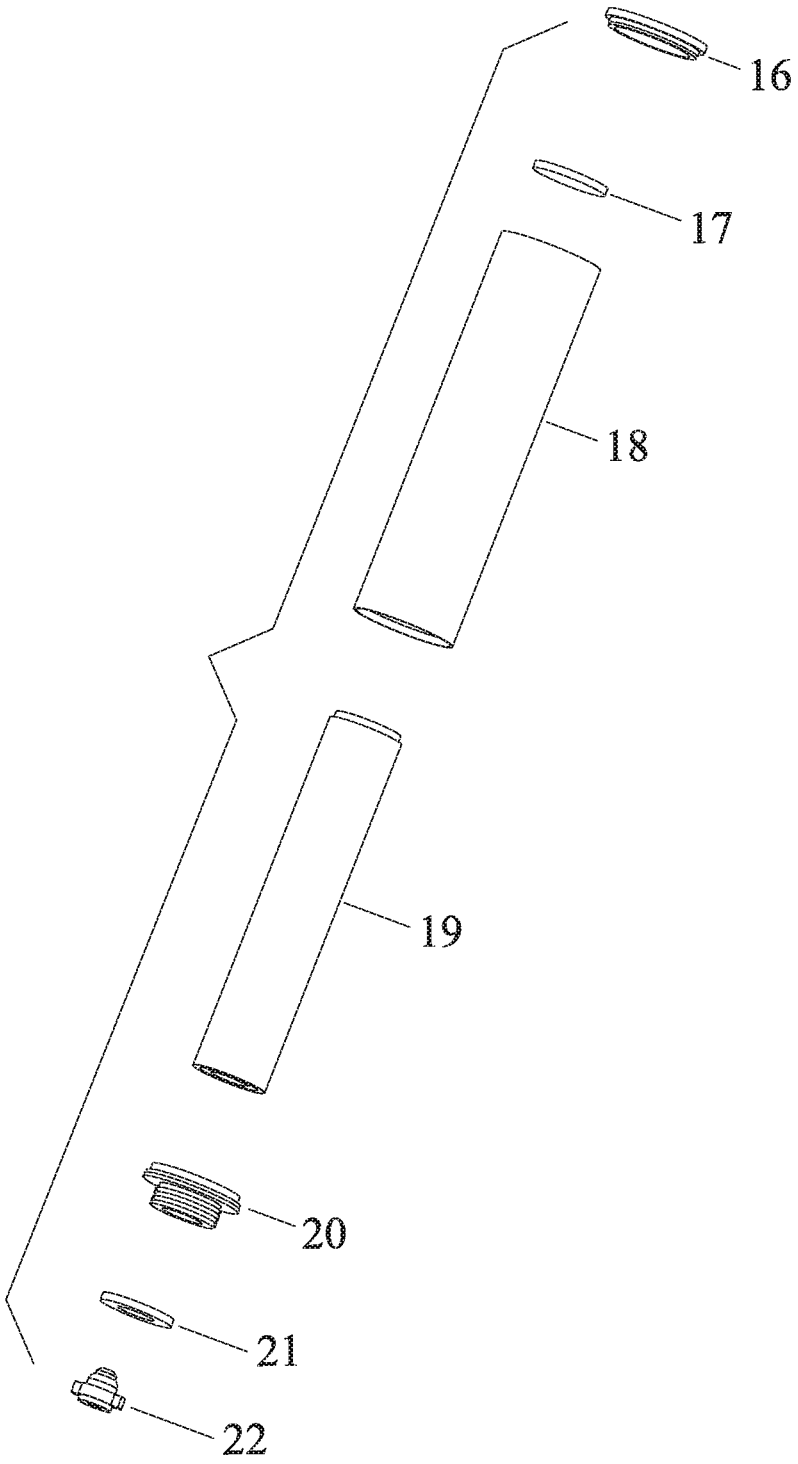
FIG. 3 is an exploded view of a battery assembly of an electronic cigarette according to one embodiment of the disclosure.
Figure 4:
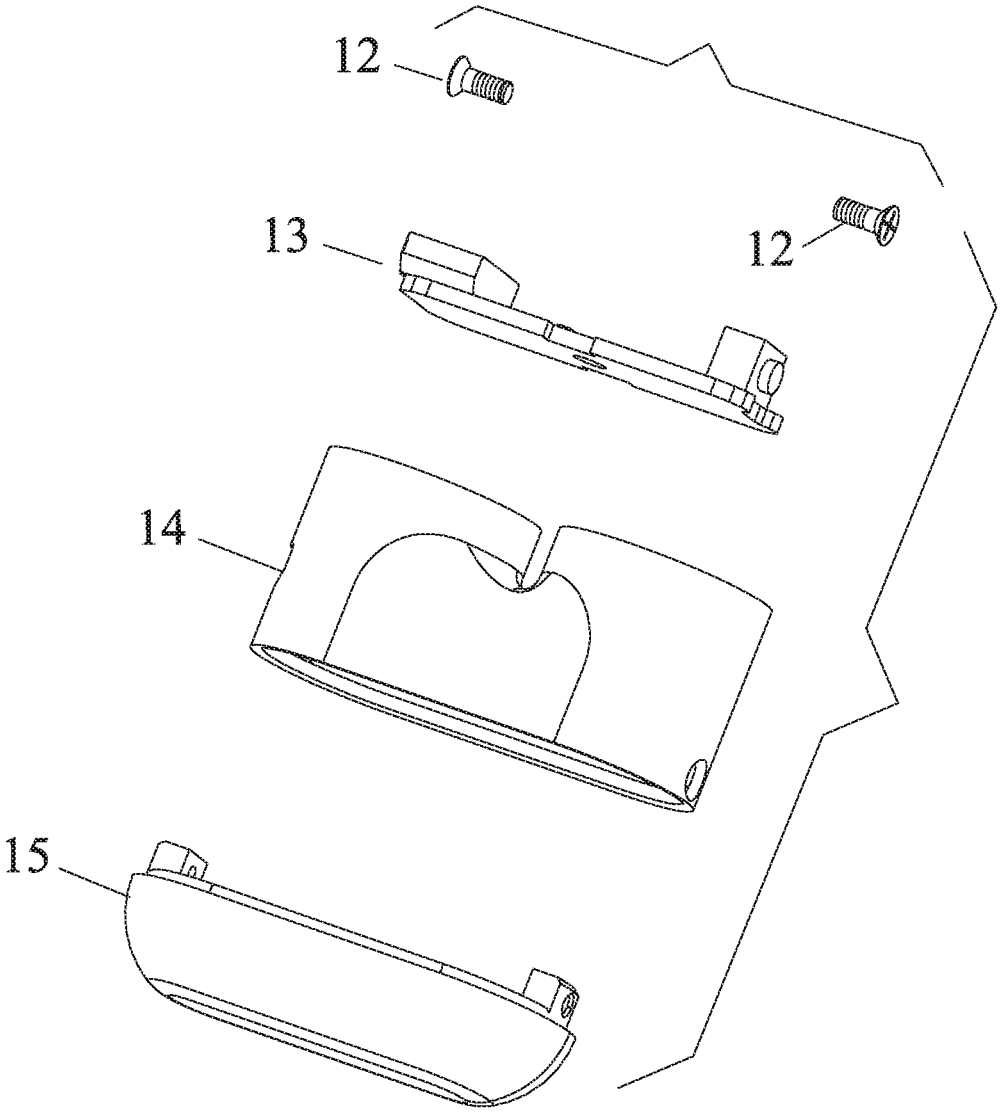
FIG. 4 is an exploded view of abase assembly of an electronic cigarette according to one embodiment of the disclosure.
Figure 5:
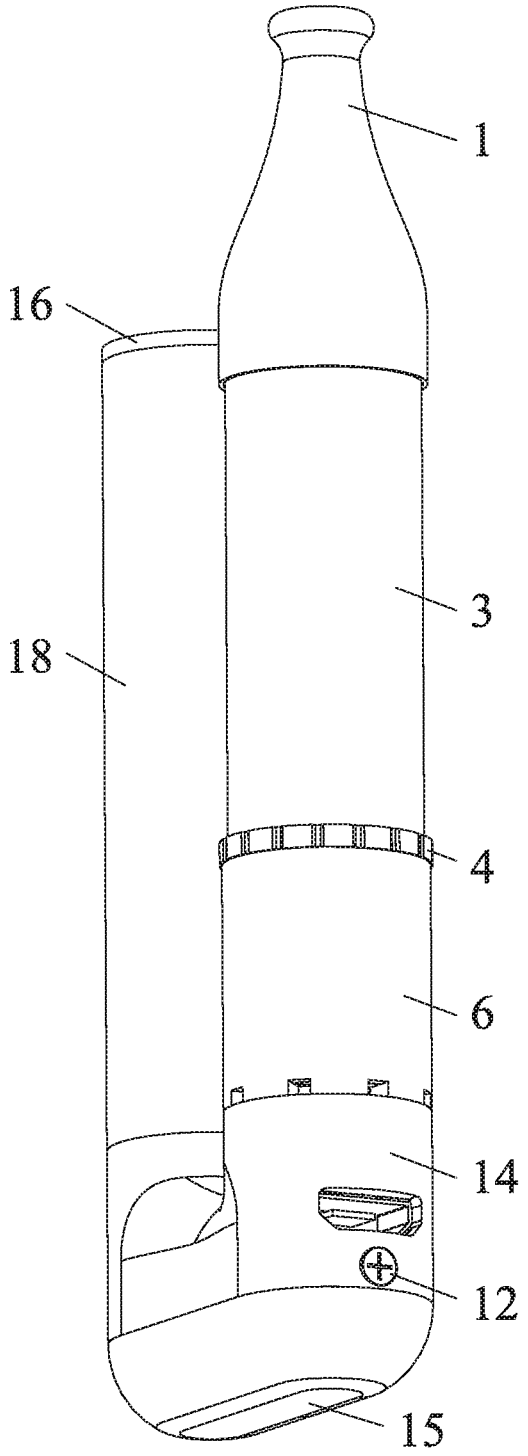
FIG. 5 is a schematic diagram of an electronic cigarette according to another embodiment of the disclosure.
Figure 6:
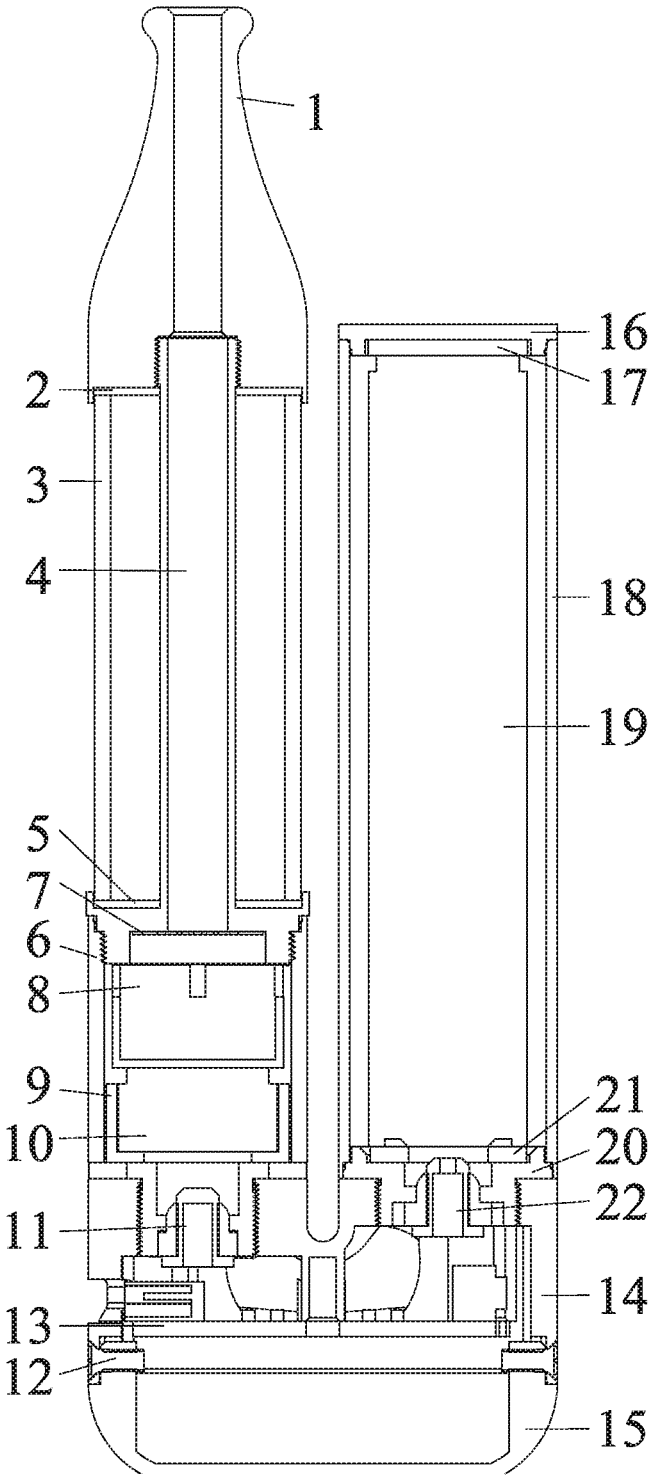
FIG. 6 is a sectional view of an electronic cigarette according to one embodiment of the disclosure.

As shown in FIGS. 1-5, an electronic cigarette comprises an atomization assembly. The atomization assembly comprises a mouthpiece 1, a first seal ring 2, a glass tube 3, a conduit 4, a second seal ring 5, a sleeve 6, a filter screen 7, a container 8, a support 9, and a ceramic core 10, and a first electrode 11. The first electrode 11 is disposed on the bottom end of the heating module for electric conduction. The ceramic core 10 is fixed on the support 9; the container 8 is disposed on the top end of the ceramic core 10; the ceramic core 10 produces heat to heat the smoke material in the container. The filter screen 7 is disposed on the top opening of the container to filter the smoke material. The container 8 is disposed in the sleeve 6. The second seal ring 5 is disposed on the bottom end of the conduit 4 to seal the bottom opening of the glass tube 3; the glass tube 3 is disposed on the conduit 4; the first seal ring 2 is disposed between the bottom end of the mouthpiece 1 and the top end of the glass tube 3 to seal the top opening of the glass tube 3; the heating module is connected to the conduit 4; and the sleeve 6 of the heating module is in threaded connection to the conduit 4.

The electronic cigarette further comprises a battery assembly B. The battery assembly B comprises an upper cover 16, a battery rod 18, a battery 19, a first ethylene vinyl acetate (EVA) gasket 17 protecting an anode of the battery, a second ethylene vinyl acetate (EVA) gasket 21 protecting a cathode of the battery, a base seat 20, and a second electrode 22. The first EVA gasket 17 and the second EVA gasket 21 are respectively disposed on the anode and cathode of the battery to insulate the battery rod 18. The battery 19 is disposed n the battery rod 18. The upper cover 16 and the base seat 20 are respectively disposed on two ends of the battery rod 18. The second electrode 22 is disposed on the bottom end of the base seat 20.

The electronic cigarette further comprises abase assembly C. The base assembly C comprises a pair of screws 12, a control panel 13, a fixing seat 14, and a base cover 15; the control panel 13 is disposed in the fixing seat 14; the pair of screws is fixed on the fixing seat, and the base cover 15 is connected to the fixing seat.

It will be obvious to those skilled in the art that changes and modifications may be made, and therefore, the aim in the appended claims is to cover all such changes and modifications.

What is claimed is:

1. An electronic cigarette, comprising an atomization assembly, a battery assembly, and a base assembly, wherein the atomization assembly comprises a heating module; the heating module comprises a sleeve, a filter screen, a container, a support, and a ceramic core; the ceramic core comprises three or more heating elements connected in parallel; the ceramic core is fixed on the support the container is disposed on a top end of the ceramic core; the filter screen is disposed on a top opening of the container; when in use, the ceramic core produces heat to heat a smoke material stored in the container;

the base assembly comprises a top surface provided with a first threaded hole and a second threaded hole disposed abreast with each other; the atomization assembly and the battery assembly are disposed side by side in the first threaded hole and the second threaded hole of the base assembly;

the electronic cigarette is in a U-shape comprising one bottom portion and two arm portions disposed on the bottom portion; and the atomization assembly and the battery assembly are in the two arm portions, respectively; and the base assembly is in the bottom portion.

2. The electronic cigarette of claim 1, wherein the atomization assembly further comprises a mouthpiece, a first seal ring, a glass tube, a conduit, a second seal ring, and a first electrode; the first electrode is disposed on a bottom end of the heating module for electric conduction; the second seal ring is disposed on a bottom end of the conduit to seal a bottom opening of the glass tube; the glass tube is disposed on the conduit; the first seal ring is disposed between a bottom end of the mouthpiece and a top end of the glass tube to seal a top opening of the glass tube; the heating module is connected to the conduit; and the sleeve of the heating module is in threaded connection to the conduit.

3. The electronic cigarette of claim 1, wherein the base assembly comprises a pair of screws, a control panel, a fixing seat, and a base cover; the control panel is disposed in the fixing seat; the pair of screws is fixed on the fixing seat, and the base cover is connected to the fixing seat.

* * * * *